US005450897A

United States Patent [19]

Brown

[11] Patent Number: 5,450,897

[45] Date of Patent: Sep. 19, 1995

[54] ROD PULL DOWN TOOL

[75] Inventor: John F. Brown, Calgary, Canada

[73] Assignee: James L. Weber, North Battleford, Canada

[21] Appl. No.: 194,024

[22] Filed: Feb. 9, 1994

[51] Int. Cl.[6] ..... F04B 47/04

[52] U.S. Cl. ..... 166/68; 166/105; 417/554

[58] Field of Search ..... 166/369, 68, 68.5, 105, 166/109; 417/555.2, 554

[56] References Cited

U.S. PATENT DOCUMENTS

| | | | |
|---|---|---|---|
| 2,215,558 | 10/1940 | Miller . | |
| 2,397,419 | 3/1946 | Humason . | |
| 2,897,768 | 8/1959 | Perry . | |
| 2,905,099 | 9/1959 | Turner | 166/68 |
| 2,952,211 | 10/1960 | Saner . | |
| 3,140,667 | 7/1964 | Anderson et al. . | |
| 3,918,845 | 11/1975 | Heard . | |
| 4,049,365 | 9/1977 | Sparks, Sr. . | |
| 4,518,036 | 5/1985 | Leffebvre et al. . | |
| 4,643,258 | 2/1987 | Kime | 166/68 X |
| 4,749,034 | 6/1988 | Vandevier et al. . | |
| 5,000,264 | 3/1991 | Snider . | |
| 5,069,285 | 12/1991 | Nuckols . | |
| 5,141,416 | 8/1992 | Cognevich et al. | 417/554 |

OTHER PUBLICATIONS

Brochure: Hydraulic Recoil Pump–USS Oilwell (Division of United States Steel).

*Primary Examiner*—William P. Neuder

*Attorney, Agent, or Firm*—Murray E. Thrift; Adrian D. Battison; Stanley G. Ade

[57] ABSTRACT

In a well using a lift pump operated by a tension string from the surface, the down stroke of the pump is accelerated by providing a plunger element secured to the pump operating string. The plunger has an upper end exposed to the high hydrostatic pressure in the tubing string above the pump, and a lower end exposed to the substantially lower hydrostatic pressure in the well outside the tubing string. This produces a net downwards force on the pump operating string allowing a higher pump speed and a higher volume delivery.

8 Claims, 3 Drawing Sheets

ROD PULL DOWN TOOL

The present invention relates to the pumping of liquids from wells, and more particularly to the pumping of liquids from wells using pumps operated by tension elements extending downhole from the surface.

Liquids are commonly drawn from wells using lift pumps. For example, in the case of oil it is common to use a reciprocating pump having a plunger reciprocating in a pump barrel. An inlet check valve admits oil into the barrel below the plunger on the upstroke and a second check valve allows the liquid to flow past the plunger into a tubing string leading to the surface. The plunger is pulled up on the upstroke by a tension element, which is usually a rod, but may be some other type of element, sometimes the tubing string itself. This lifts the column of liquid in the tubing string towards the surface, and draws additional liquid into the barrel through the inlet check valve. On the down stroke of the pump, the plunger descends by gravity and oil that is captured in the barrel passes through the second check valve to be lifted by the plunger in the next upstroke.

A major limitation on the delivery flow rate of a pumping system of this sort is the speed at which the plunger and tension element will descend on the down stroke. Down strokes of the tension element can be resisted by viscous drag forces of a significant magnitude. This resistance cannot be overcome by large axial compression forces on the tension element without unacceptable bending. Consequently, the plungers and rods descend slowly, against the resistance of the liquid to be pumped. This resistance can be quite high. With heavy oils, it becomes the limiting factor on the rate of delivery from any given well.

The present invention therefore aims at the provision of methods and apparatus for mitigating this problem.

According to one aspect of the present invention there is provided a method of pumping liquid from a well with a pump in the well for lifting a column of liquid along a tubing string and a tension element extending along the well for operating the pump, said method comprising:

raising the tension element along the well to operate the pump and lift the column of liquid in the tubing string and to add further liquid to the column;

providing a pull-down plunger attached to the tension element for movement therewith;

exposing a top end of the pull-down plunger to the static pressure of liquid in the tubing string; and exposing a bottom end of the pull-down plunger to a low static pressure substantially less than the static pressure to which the top of the plunger is exposed, whereby the pressure differential on the plunger will urge the tension element downwardly in the well.

The pressure differential across the plunger may be very high, depending on the height of the liquid Column in the tubing string. This forces the plunger down, pulling the tension element down to start a new stroke. This method produces a considerable reduction in down stroke time and consequently allows a higher overall pump speed and a higher delivery rate.

According to another aspect of the present invention there is provided a pumping system for pumping liquid from a well, said system comprising:

a tubing string extending down the well;

pump means for lifting a column of liquid in the tubing string;

tension means extending down the well and movable therealong for operating the pump means; and pull down means including plunger means engaged with the tension means, the plunger means having an upper end exposed to the static pressure of the column of liquid in the tubing string and a lower end exposed to a pressure substantially equal to ambient static pressure in the well outside of the well tubing, whereby the differential pressure on the plunger means forces the plunger means and the tension means downwardly in the well.

The pull down may be incorporated in the design of the pump. Thus, according to another aspect of the present invention there is provided a pump for pumping liquid from a well through a tubing string, said pump comprising:

a pump barrel coupled to the tubing string;

a plunger reciprocable in the pump barrel;

tension means extending along the tubing string to the plunger for pulling the plunger upwardly in the pump barrel;

inlet check valve means for allowing liquid flow from the well into the pump barrel below the plunger;

outlet check valve means for allowing liquid to flow from below the plunger to above the plunger, to pass into the tubing string;

liquid passage means between the inlet and outlet check valves for confining the flow of liquid therebetween; and means for maintaining a portion of the barrel below the plunger at substantially the ambient static pressure in the well outside of the pump.

According to a further aspect of the present invention there is provided a pull down tool for use in a well pumping system having a lift pump, a tension element for operating the pump, and a tubing string for receiving liquid pumped by the pump, the pull down tool comprising:

housing means engageable in the tubing string for defining a chamber above the pump, in fluid communication with the tubing string;

plunger means reciprocable in the chamber;

plunger mounting means for mounting the plunger means on the tension element for movement therewith; and means for maintaining a portion of the chamber below the plunger substantially at the ambient pressure outside of the tubing string.

In the accompanying drawings, which illustrate exemplary embodiments of the present invention:

Figure 1:
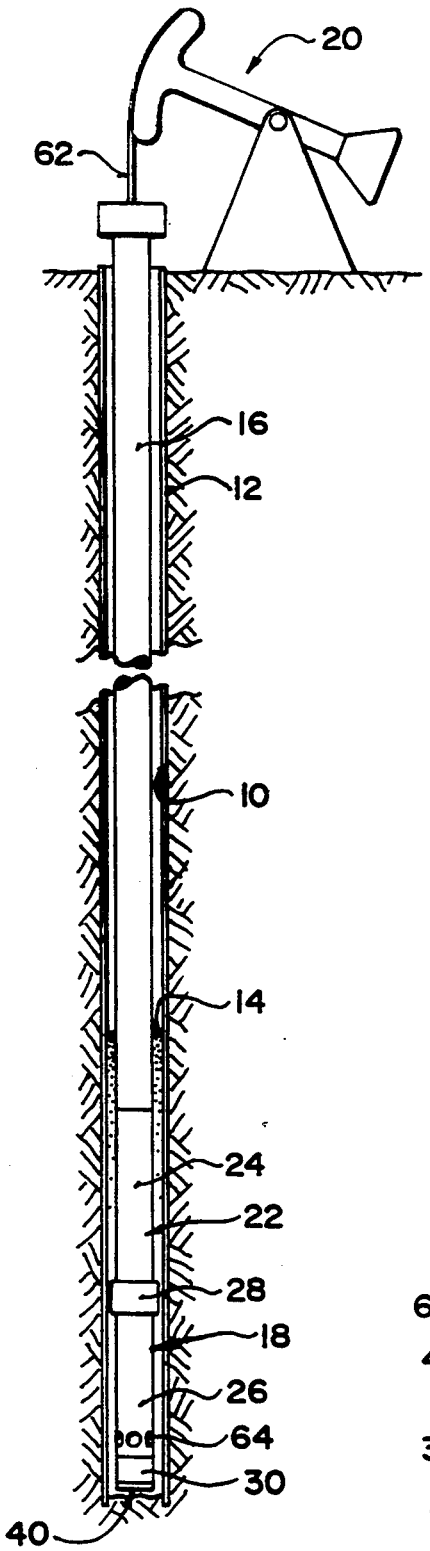
FIG. 1 is a longitudinal section of a well bore showing a system according to the present invention.

Referring to the accompanying drawings, FIG. 1 is a longitudinal section of an oil well. The well has a bore 10 lined with the usual casing 12 extending into the earth to a level below the top of a reservoir of oil 14.

Within the casing is a tubing string 16 for leading oil from the reservoir to the surface. The bottom end of the tubing is connected to a pump 18 that lifts the column of oil in the tubing string. At the surface is a pump jack 20 that operates the pump through a rod string.

Figure 2:
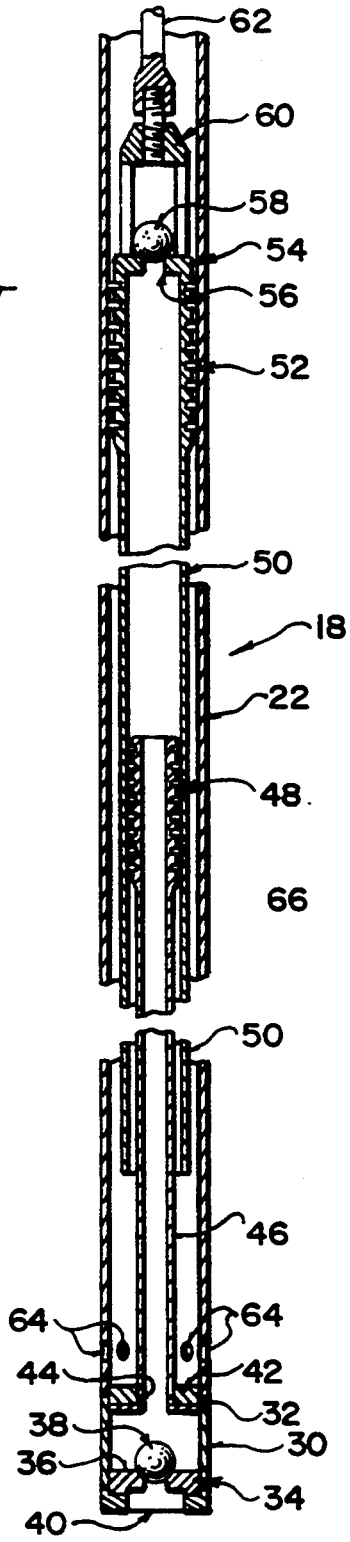
FIG. 2 is an axial section through a pump incorporating the present invention.
Figure 3:
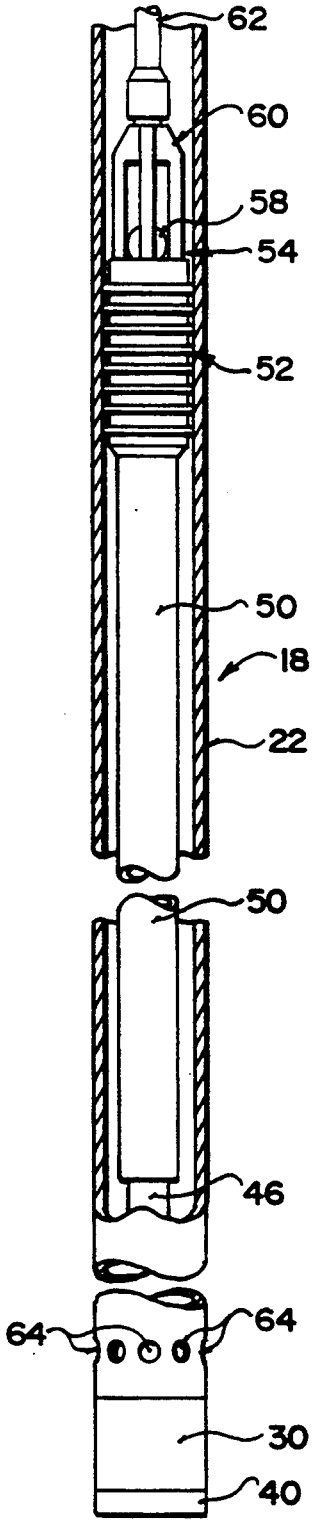
FIG. 3 is a side elevation of the pump, partially in section.

The configuration of the pump 18 is illustrated most particularly in FIGS. 2 and 3. The pump includes an outer barrel 22 that, in this embodiment, includes an upper barrel section 24 and a lower barrel section 26 coupled by a collar 28 (see FIG. 1). At its bottom end, the barrel 22 is screwed onto a sleeve 30 using threads 32. Within the sleeve is an inlet check valve 34 including a valve seat 36 and ball 38. The seat is retained in the sleeve by an end cap 40 threaded onto the bottom of the sleeve 30.

Just above the bottom end of the barrel 22 is an end plate 42 with a central bore 44. A tubular prong 46 is secured to the end plate 42 and extends upwardly from the bore 44 in the centre of the barrel 22. A soft pack plunger 48 is fixed on the top end of the prong 46. Surrounding the plunger 48 and sealed to it is an inner barrel 50 connected at its upper end to another soft pack plunger 52. The combination of inner barrel 50 and plunger 52 travels along the barrel 22. At the top of the travelling plunger 52 is a check valve 54 including a seat 56 and a ball 58. The ball is held captive by a cage 60 on the top of the plunger. The cage is in turn connected to the bottom end of a sucker rod string 62 extending to the well head for connection to the pump jack.

Near the bottom of the barrel 22 is a series of ports 64, venting the interior of the barrel below the plunger 52 to the well outside the pump barrel. The ports are of sufficient in size and number that the pressure inside the chamber 66 between the barrel 22, inner barrel 50 and prong 46 remains substantially at the ambient pressure of the well outside the barrel.

In operation of this pump, the rod string 62 will pull up on the assembly of the plunger 52 and inner barrel 50. This will seat the ball 58 of check valve 54 and lift the column of liquid in the tubing string towards the surface. At the same time, the suction inside the inner barrel 50 and the prong 46 will draw oil through the inlet check valve 34 to maintain the prong and inner barrel full of oil. When the tension on the rod string 62 is released, the rod string 62, the plunger 52 and inner barrel 50 will descend in the tubing string and outer barrel 22. The inlet check valve 34 will close, while the check valve 54 will open to allow liquid to pass from the inner barrel 50 into the outer barrel and tubing string above the plunger 54. During this down stroke, the static pressure of the liquid column in the tubing string will be exerted on the top of the travelling plunger 52, while the bottom of the plunger, outside the inner barrel, is exposed to the much lower ambient pressure within the well around the pump barrel. This produces a large downward force on the plunger 52 pushing the plunger down and pulling with it the rod string 62.

Once the plunger 52 and the associated components of the pump have returned to their bottom position, they may be lifted again by the pump through tension on the sucker rod string.

Figure 4:
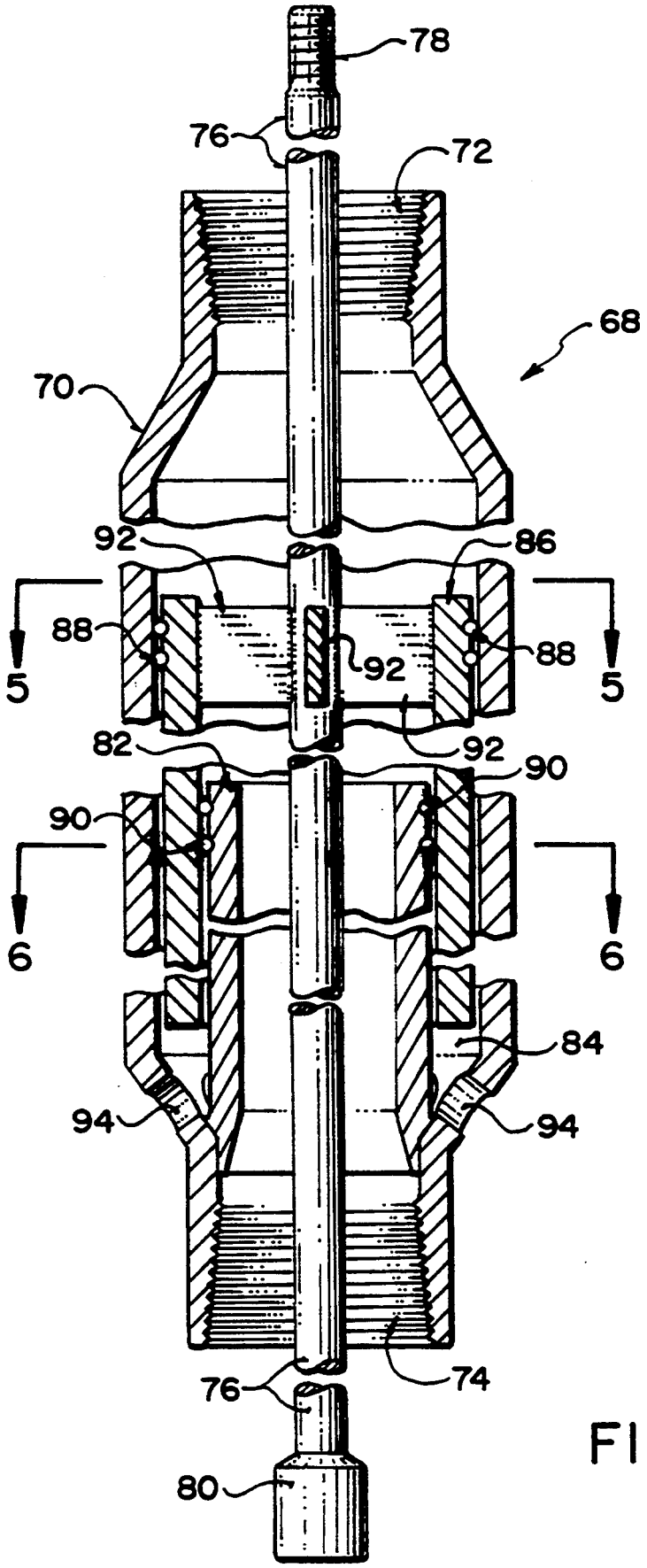
FIG. 4 is a section of a pull down device.
Figure 5:
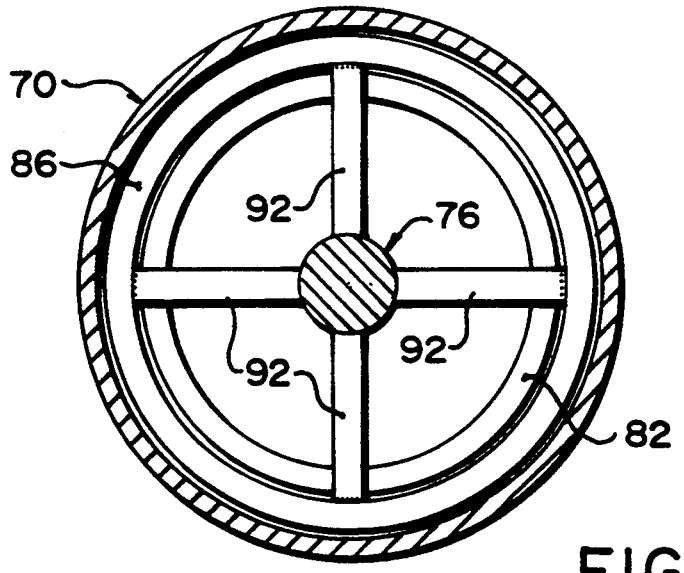
FIG. 5 is a view along line 5—5 of FIG. 4.
Figure 6:
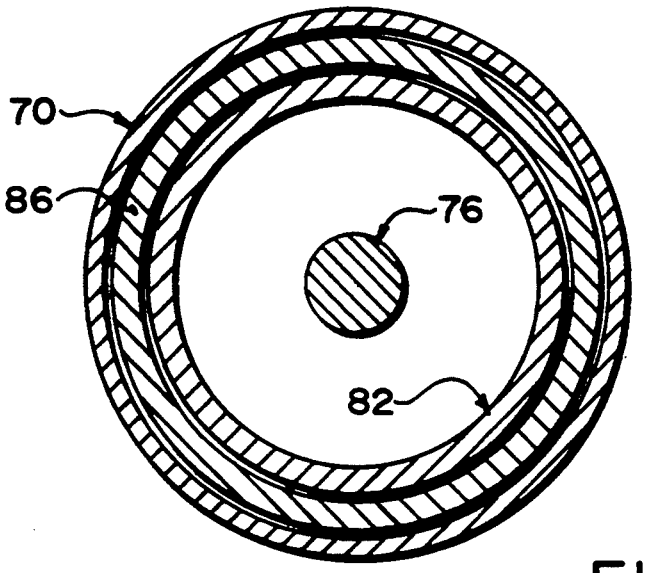
FIG. 6 is a view along line 6—6 of FIG. 4.

FIGS. 4, 5 and 6 of the drawings illustrate an alternative embodiment of the invention in which the same effect is achieved using a pull down tool separate from the pump. In this embodiment, the pull down tool 68 has a housing 70 with tubing couplings 72 and 74 at its top and bottom ends respectively. The housing is connected into the tubing string, preferably near the pump. Along the centre of the housing 70 is a rod section 76 with couplings 78 and 80 connecting the rod section in the rod string. Within the housing is a cylindrical inner wall 82. This projects upwardly from the bottom of the housing to provide an open-topped annular chamber 84 around the inside of the housing wall. The chamber 84 accommodates a plunger in the form of a travelling sleeve 86. The sleeve is sealed to the inside of the housing wall by annular seals 88 and to the outside of the inner wall 82 by annular seals 90.

The travelling sleeve is connected to the rod 76 by a set of radial arms 92 so that the rod and the travelling sleeve will reciprocate together.

At the bottom of the chamber 84 is a series of ports 94 that vent the chamber below the travelling sleeve 86 to the ambient conditions outside of the tubing string. The ports to maintain the pressure within the chamber at a level substantially equal to the outside ambient pressure.

In use of the pull down tool of FIGS. 4, 5 and 6, the top of the travelling sleeve 86 is exposed to the large hydrostatic head within the tubing string. The bottom of the travelling tube is, on the other hand, exposed to the considerably lower ambient pressure outside of the tubing string. Consequently, there will be a net differential pressure exerted on the sleeve urging it downwardly. Through its connection to the rod 76 and thence to the complete rod string, this will accelerate the down stroke of the rod and provide for a much faster pump operation.

While certain embodiments of the invention have been described in the foregoing, it is to be understood that the invention is not limited to those embodiments but may be expressed in numerous other embodiments that will occur to others skilled in this technology. The invention is to be considered limited solely by the scope of the appended claims.

I claim:

1. A pumping system for pumping liquid from a well, said system comprising;

a tubing string extending down the well;

pump means for lifting a column of liquid in the tubing string, the pump means including an outer pump barrel and an inner pump barrel inside the outer pump barrel, annular outer plunger secured to the inner pump barrel for reciprocation in the outer pump barrel, a tubular prong extending along the inner pump barrel, an annular inner plunger secured to the tubular prong, the inner pump barrel being reciprocable along and sealed to the inner plunger, and check valve means for allowing fluid to pass from the well through the prong and the inner plunger to the inner barrel;

tension means extending down the well and movable therealong for operating the pump means; and pull down means including means for venting the space between the outer and inner barrels and below the outer plunger to the well outside of the well tubing, the outer plunger thereby having an upper end exposed to the static pressure of the column of liquid in the tubing string and a lower end exposed to a pressure substantially equal to ambient static pressure in the well outside of the well tubing, whereby the differential pressure on the outer plunger forces the plunger means and the tension means downwardly in the well.

2. A system according to claim 1 wherein the pump means comprise check valve means for allowing fluid to pass from the inner barrel, through the outer annular plunger into the outer pump barrel.

3. A pumping system for pumping fluid from a well, said system comprising:

a tubing ring extending down the well;

pump means for lifting a column of liquid in the tubing string;

tension means extending down the well and movable therealong for operating the pump means; and pull down means including an annular pull down chamber forming part of the well tubing, the chamber comprising inner and outer walls, an annular plunger reciprocable in the pull down chamber and engaged with the tension means, seal means for sealing the plunger to the inner and outer walls of the pull down chamber such that an upper end of the plunger is exposed to the static pressure of the column of liquid in the tubing string and a lower end, of the plunger is exposed to a pressure within the pull down chamber, and means for venting a, lower part of the pull down chamber to the well outside the well tubing so that the lower end of the plunger is exposed to a pressure substantially equal to ambient static pressure in the well outside of the well tubing, whereby the differential pressure on the plunger forces the plunger and the tension means downwardly in the well.

4. A pump for pumping liquid from a well through a tubing string, said pump comprising:

a pump barrel coupled to the tubing string;

a plunger reciprocable in the pump barrel;

tension means extending along the tubing string to the plunger for pulling the plunger upwardly in the pump barrel;

inlet check valve means for allowing liquid flow from the well into the pump barrel below the plunger;

outlet check valve means for allowing liquid to flow from below the plunger to above the plunger, to pass into the tubing string;

liquid passage means between the inlet and outlet check valves for confining the flow of liquid therebetween the liquid passage means comprising an inner barrel extending downwardly from the plunger within the pump barrel, a tubular prong extending upwardly from the inlet valve inside the inner barrel, and an inner plunger sealing the prong to the inside of the inner barrel; and means for maintaining a portion of the barrel below the plunger at substantially the ambient static pressure in the well outside of the pump.

5. A pull down tool for use in a well pumping system having a lift pump, a tension element for operating the pump, and a tubing string for receiving liquid pumped by the pump, the pull down tool comprising:

housing means engageable in the tubing string for defining a chamber above the pump, in fluid communication with the tubing string;

plunger means reciprocable in the chamber;

plunger mounting means for mounting the plunger means on the tension element for movement therewith; and means for maintaining a portion of the chamber below the plunger substantially at the ambient pressure outside of the tubing string.

6. A tool according to claim 5 wherein the chamber means comprise inner and outer walls defining an annular pull down chamber therebetween and the plunger means comprise an annular plunger reciprocable in the annular chamber.

7. A tool according to claim 6 including seal means for sealing the plunger to the inner and outer walls of the pull down chamber.

8. A tool according to claim 7 wherein the outer wall comprises coupling means for coupling the outer wall into the tubing string.

* * * * *